United States Patent [19]

Hart

[11] 4,414,695

[45] Nov. 15, 1983

[54] HYDROJET

[76] Inventor: James F. Hart, 2012 NE. 17th Terr., Fort Lauderdale, Fla. 33305

[21] Appl. No.: 295,605

[22] Filed: Aug. 24, 1981

[51] Int. Cl.[3] ..... A61H 33/02; B01F 3/04

[52] U.S. Cl. ..... 4/542; 128/66; 285/2; 261/88; 4/559

[58] Field of Search ..... 261/88, 93; 4/541-544, 4/546, 548, 538, 488, 492, 567-569, 142; 239/428.5, 587, 443-444, 446-449, DIG. 1; 128/66; 285/1-4

[56] References Cited

U.S. PATENT DOCUMENTS

| | | | |
|---|---|---|---|
| 3,195,817 | 7/1965 | Sandie | 239/252 |
| 3,319,260 | 5/1967 | Schneider et al. | 4/542 X |
| 3,358,934 | 12/1967 | Moen | 239/443 X |
| 3,558,054 | 1/1971 | Ragot | 239/DIG. 1 |
| 3,605,735 | 9/1961 | Soden | 128/66 X |
| 3,806,964 | 4/1974 | Vanegas et al. | 4/542 X |
| 4,146,288 | 3/1979 | Ramsay et al. | 285/2 |

*Primary Examiner*—Stephen Marcus
*Assistant Examiner*—Kenneth S. Putnam
*Attorney, Agent, or Firm*—Oltman and Flynn

[57] ABSTRACT

A generally centrally located, positionable, rotating or stationary hydrotherapeutic multiple jet head for use in a water filled receptacle such as a spa, tub or swimming pool to provide innumerable variations in the jet stream patterns, force, depth and direction relative to an occupant in the water filled receptacle. The device is an air and water jet head having multiple levels of radially oriented jets and position adjustable water and air inlet tubes coupled to said jet head that allow the jet head to be positioned vertically, horizontally and to tilt through a wide range within the receptacle. The user can position the location of the jet head and select the jet stream patterns emanating from the head. A variable speed rotating jet stream feature is also included which provides a soothing wave-like effect. The air and water inlet tubes may connect to the jet heat from below or above. Operating and installation costs are reduced due to simplified piping and shorter jet stream travel distances. More than one jet head could be installed in a large receptacle, each to service a selected area.

11 Claims, 13 Drawing Figures

HYDROJET

RELATED APPLICATION

This application relates to co-pending application Ser. No. 295,606, filed on Aug. 14, 1981.

FIELD OF THE INVENTION

This invention relates to a hydrotherapeutic multiple jet head which is adapted to be positioned central to the area to be serviced within a tub, spa or swimming pool and more particularly to an improved device which is adjustable with respect thereto.

BACKGROUND OF THE INVENTION

This invention is a therapeutic jet head which injects water together with air, if desired, using venturi nozzles, against the bodies of occupants usually partially immersed in a spa, tub, or swimming pool.

In a conventional spa, the jet stream is normally directed into the receptacle through fixed venturi nozzles positioned in the side walls of the receptacle that receive water under pressure through a piping system from a common pump. In-the-wall jets have several drawbacks. One drawback is that the jet pattern is relatively fixed since the jet nozzles usually have only a limited arc of movement and are in fixed locations. Thus the jets of a spa so equipped are limited in coverage or are blocked by occupants due to their in-the-wall location. Another drawback is that the impact pressure from the jets is not generally adjustable or only through a limited range. Another drawback is that the jet streams must generally travel a long distance to impinge on the front of an occupant on the other side of the receptacle, and are thus dissipated or must be more powerful, requiring a large pump and pipes to achieve the desired effect. Fixed jets of conventional systems also require relatively extensive plumbing. Finally it is readily understood that only minor jet pattern changes are available using conventional systems, and that continuously changing patterns are not available.

SUMMARY OF THE PRESENT INVENTION

The present invention eliminates the necessity for fixed jets by providing a jet head that can be positioned over a wide area within the spa, tub or swimming pool receptacle, reducing power requirements for a greater jet stream force at any location and employing a variable jet head that itself has an adjustable jet stream pattern.

For a spa having a water pump or other source of water under pressure, this invention provides an air and water jet assembly comprising (1) an air inlet tube in communication with the atmosphere or other source of air, (2) a water inlet tube in communication with a source of water under pressure, and (3) a multi array jet head having a water inlet and an air inlet. The air may be omitted, if desired. The jet head is composed of a water diverter member in fluid engagement with the water inlet tube. The diverter has a plurality of generally horizontal, outwardly facing jet nozzles. About the diverter an annular member containing jet orifices axially aligned with the jet nozzles is provided in spaced relation from the diverter, defining an annular chamber about the diverter. The air inlet tube is in open communication with said annular member and said annular chamber about the diverter. A plurality of axially movable members are provided in the chamber adapted to block some of the nozzles. The assembly includes means to connect the jet head to the water and air inlet tube. Adjustment means, which are exteriorly accessible of the jet head, are provided for adjusting the location axially of the annular members in said space. The jet head may include a rotary bearing which in combination with diametrically offset nozzles permits rotation of the jet head.

OBJECTS AND ADVANTAGES OF THE PRESENT INVENTION

An object of this invention is to provide a low cost and economical jet system that vastly enhances the occupant's enjoyment of the hydrotherapeutic bath by providing variable effects through the use of a multiple jet head capable of position adjustment, varying jet stream patterns, and a rotary soothing wave-like jet stream action. Another object is to provide instantly changeable jet stream patterns through the use of a multiple array jet head wherein the occupant may select such patterns as area, zone, spot, or spa shape coverage, all of which may be pointed through a 360 degree arc or rotated at various speeds to provide additional effects on the occupants within the receptacle. However, if desired, interchangeable jet heads could be provided as a less convenient means to change the jet stream patterns.

Another object is to provide interchangeably sized nozzles and orifices to permit, for example, user options as to the jet stream force delivered by the jet head.

Another object is to provide a means to permit the jet head to approach or recede from an occupant, to tilt the plane of the jet stream pattern from the normal horizontal position, and increase or decrease the depth under the water of the jet stream pattern, as for example, if desired to have a jet stream or streams impinge on an occupant's knee. An advantage over conventional systems is that piping runs and jet stream to occupant distances are shorter, thus reducing operating costs.

Another object is that through the use of a variable displacement pump and a water pressure sensing device the volumetric output of the jet head may be reduced when jet stream patterns are selected which, due to the size and number of jets operating, require less pump output, thus additionally reducing power consumption.

Another advantage is that all jet head controls are centrally located, easily accessible to all occupants.

Another object is to provide a means to control the amount of or absence of entrained air in the jet stream.

DESCRIPTION OF THE PREFERRED EMBODIMENT

Figure 1:
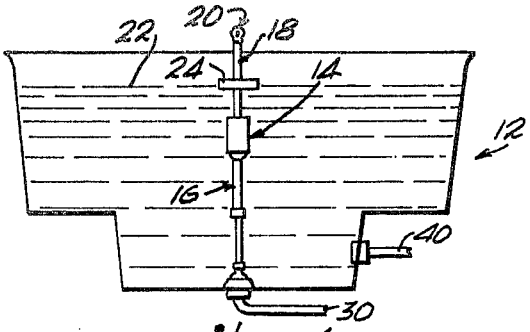
FIG. 1 is an elevation view generally illustrating the invention arranged in a spa.

Referring to the drawings wherein like reference characters designate like or corresponding parts throughout the several views, there is shown and generally designated by the numeral 12 the outline of a conventional spa or large tub in which, conventionally, water and air in a mixture is generally directed from the peripheral wall toward the center of the spa. Within the spa of the instant invention, it is seen that a different device is utilized now to be described. The device is composed of a jet head, generally designated by the numeral 14, which is provided with an inlet tube 16 for water and an inlet tube 18 for air. Pipe 30 is a water feed line from the pump and pipe 40 is a return line to the pump. The air inlet tube has an upper end 20 at all times in use located above the water line 22 and within which air is entrained or sucked by the water flow which is pumped through the device under pressure. The air inlet tube 18 is preferably provided with a float 24 which rides on the water line 22. This combination is shown also in FIG. 2.

Figure 2:
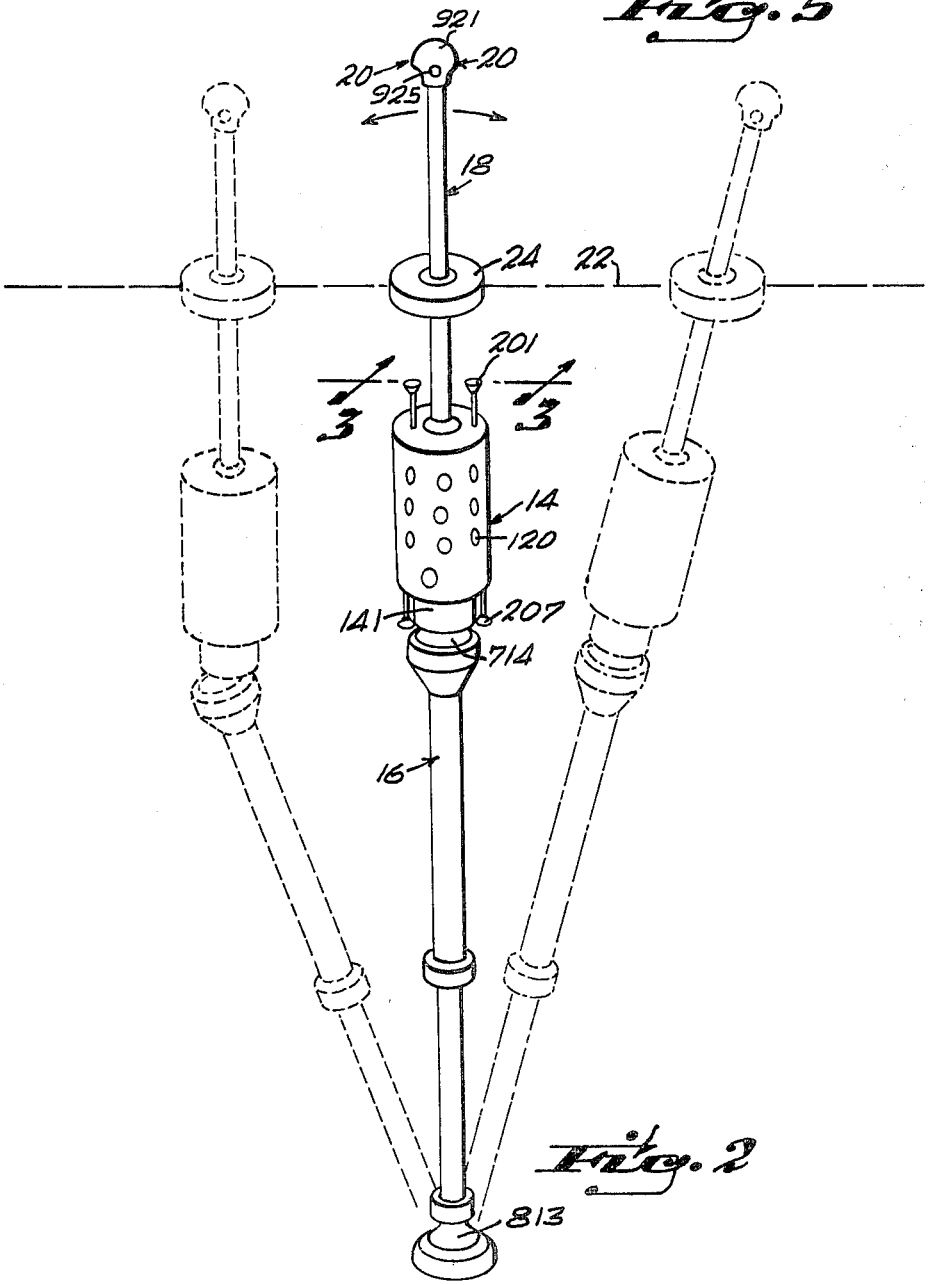
FIG. 2 is a view of the instant invention.
Figure 3:
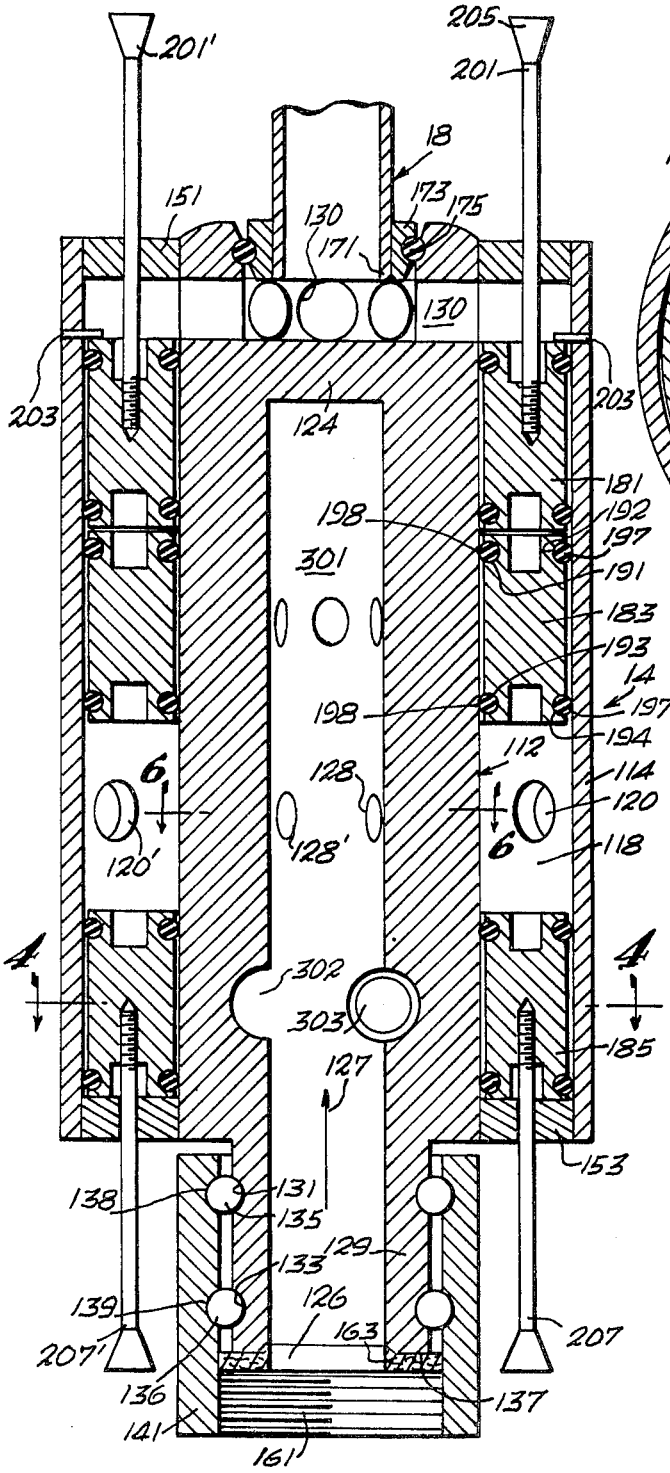
FIG. 3 is a view in longitudinal section of the jet head in the zone designated in FIG. 2 and taken on the vertical plane designated by the arrowed lines 3—3 and looking in the direction of the arrows.

Referring now to FIG. 3 in which the jet head 14 is seen, it is composed of a generally inverted cup-shaped water diverter 112 about which there is arranged a co-cylindrical outer annular member 114 defining between the diverter and the member an annular chamber 118. It is in this chamber that air is picked up to entrain with water prior to exiting through jet orifices 120 (FIG. 2) in the wall of the outer annular member 114.

Figure 4:
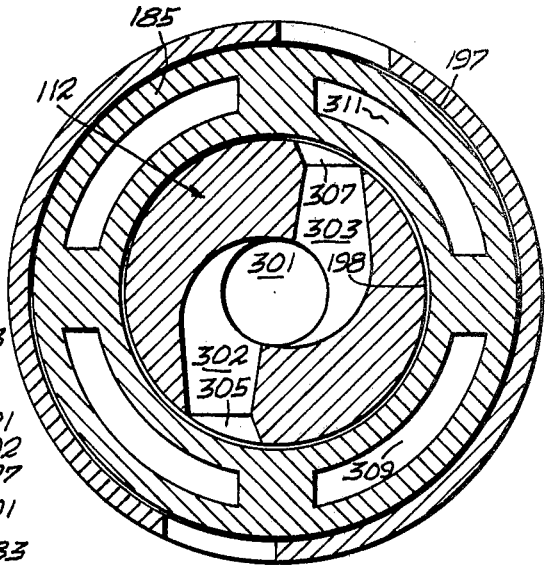
FIG. 4 is a cross section taken on the horizontal plane indicated by the line 4—4 of FIG. 3 and looking in the direction of the arrows.
Figure 6A:
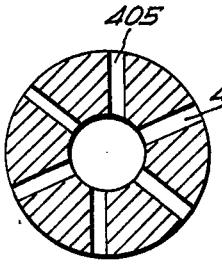
FIGS. 6A through D are optional diverter structures illustrating some of the various combinations of jet nozzles which may be employed.
Figure 6B:
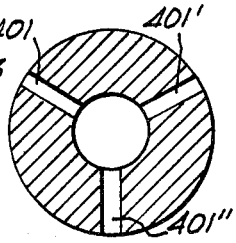
Figure 6C:
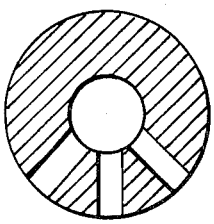
Figure 6D:
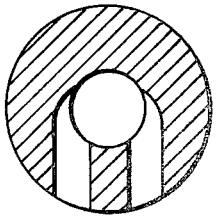

As shown in FIG. 2, the outer annular member 114 of jet head 14 has four rows of circumferentially spaced jet orifices 120 at different levels along its length. The lowest row has two jet orifices, as shown in FIG. 4. The rows above have more than two orifices in each, as shown in FIG. 2. Referring to FIG. 3, the annular chamber 118 between the outer member 114 and the diverter 112 in the jet head receives three blocking rings 181, 183 and 185. The lower ring 185 is slidably adjustable between a position blocking the lowest row of jet orifices in outer member 114, as shown in FIG. 3, and a raised position in which it uncovers the lowest row of jet orifices and blocks the orifices in the next row up. The upper ring 181 is adjustable between a position blocking the top row of jet orifices, as shown in FIG. 3, and a lowered position in which it uncovers the top row of jet orifices and uncovers the jet orifices in the next row down. The middle ring 183 is adjustable between a position blocking one or the other of the two middle rows of jet orifices.

Referring more in detail to the diverter 112, it is seen that it includes a closed upper end 124 and an open lower end 126 in fluid communication with the water inlet tube 16 so that water entering in the direction of the arrowed lines 127 is constrained by reason of its being under pressure to exit through one of the openings in the diverter, such as those indicated by the numerals 128 and 128'. These openings may be considered to be jet nozzles for the pressurized water flow into the annular chamber 118. These water jet nozzles may be of different displacements or diameters, as desired, and may be tapered or shaped to reduce dispersion of the emitted jet stream. The water jet nozzles (e.g. 128 and 128') are axially aligned, individually with the jet orifices 120 in the outer annular member 114 of the jet head and may be horizontal, as shown, or inclined or declined from the horizontal. The open lower end 126 of the diverter is defined by a downwardly extending cylindrical wall 129. In the wall 129 annular grooves 131 and 133 are provided to accommodate balls 135 and 136 for companionate engagement with similar grooves 138 and 139 in an outer bearing race member 141. By reason of this structure, the diverter 112, which is secured to the housing 114 by end caps 151 and 153, is free to rotate with respect to the outer bearing race member 141 about its vertical axis in FIG. 3. The outer bearing 122 race member 141 is internally threaded at 161 for connection to the upper end of the water inlet tube 16 and preferably is provided with an elastomeric washer which seals and provides a friction connection with the bottom surface 137 of diverter 112 and the top surface 723 of ball 714 in FIG. 7. By tightening bearing race member 141 in relation to ball 714 additional friction will slow or stop rotation. Other types of bearings could be substituted for the ball bearing.

Referring to FIG. 3, with respect to the air inlet tube 18, it is provided on its lower end 171 with a collar 173 fixed thereto which, through the O-ring 175, is engaged with the upper end of the diverter 112. If impacted, the air inlet tube 18 is free to separate from the jet head 14. Air from the atmosphere is pulled down through tube 18, through radial openings 130 in diverter 112, and then through longitudinal passageways in blocking rings 181 and 183 into chamber 118. Within the diverter there are generally radially facing nozzles, such as 128 and 128', which communicate with the aforesaid annular chamber 118. Axially arranged within the annular chamber 118 are the blocking rings 181, 183, and 185. Each of these rings is axially movable into adjusted positions closing or opening the nozzles and orifices, such as 128 and 120 respectively. Preferably, each of these axially slidable blocking rings, 181, 183, and 185, is provided with annular grooves, such as 191, 192, 193, and 194 to receive O-rings, such as that designated by the numeral 197 and 198.

Adjustment means to axially move the rings 181, 183, and 185 to any of several desired levels or positions comprise push-pull rods, such as those for the upper ring 181, which are designated by the numerals 201 and 201', each of which has an inner end in threaded engagement with the uppermost ring 181 and an enlarged headed portion 205 at the top so that by pushing axially or pulling axially the rings may be adjusted axially. Two diametrically opposed stop pins 203 prevent ring 181 from blocking openings 130. Also, at the bottom push-pull rods 207 and 207' are provided and similarly connected to the lowermost ring 185 as shown. It is thus seen that by manipulating these rods, the axial positions of the rings 181, 183 and 185 may be adjusted. This adjustment opens the diverter jet nozzles and orifices at any of the four different levels, for example at the level of the plane indicated by the line 6—6 of FIG. 3.

By reason of the structure described, the unitary assembly of the diverter 112 and the annular outer member 114 is adapted to rotate relative to the outer bearing race 141 and water inlet tube 16. In so doing, this causes the outflow of the mixture of water and air to change direction continually with the rotation.

With respect to FIG. 4, the diverter 112 seen at this level in cross section has an axially extending chamber 301 and generally radially offset portions 302 and 303 extending laterally out from opposite sides of axial chamber 301 to chamfered mouths 305 and 307, respectively. This configuration is an example of a rotary array in which the flow of water out through the passages 302 and 303 will cause the jet head to rotate. The annular ring 185 in FIG. 4 has axially extending air passageways such as 309 and 311 to permit airflow vertically through the chamber 118, as do rings 181 and 183.

Referring to FIG. 3, it is seen that the water will not be able to exit at the level or plane designated by the line 4—4 because the ring 185 is in blocking relation to the diverter nozzles 302 and 303 from the jet orifices 120 in the annular outer member 114 of the jet head.

It will be appreciated on reference to FIGS. 6, A, B, C, and D, that the location and size of the nozzles in the diverter 112 may be varied. For example, in FIG. 6A, nozzles 403 are diametrically aligned whereas nozzles 405 are diametrically offset to cause rotation, by the force component of the emitted jet stream. In FIG. 6B nozzles 401, 401′ and 401″ are of a different number than the nozzles of FIG. 6A and would be used, for example, in a partially occupied spa, with a variable displacement pump activated for example, by a pressure sensing switching mechanism, to reduce power consumption. FIG. 6C shows a zone coverage array and FIG. 6D a spot coverage array.

Figure 6E:
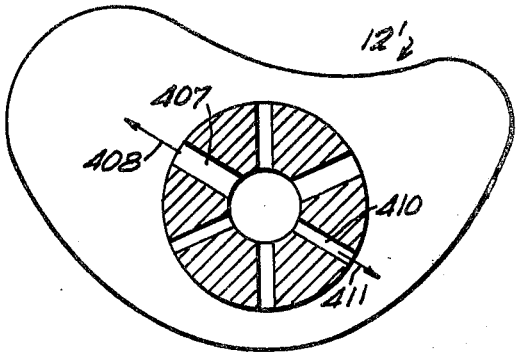
FIG. 6E is a plan view illustrating a diverter schematically in relation to a non-circular spa as seen in plan.

Referring to FIG. 6E, it will be appreciated that in the event that the spa 12′ is of a configuration there shown, differing from that of the symmetrical spa shown in FIG. 1, that one might arrange a larger nozzle, such as 407, to direct water and air in the direction of the arrowed line 408 in contrast to that of the nozzle 410 emitting in the direction of the arrowed line 411.

Figure 5:
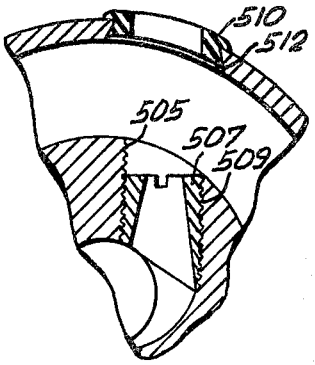
FIG. 5 is a partial view in cross section illustrating fittings which may be utilized to change the size of the jet nozzles and orifices.

With respect to FIG. 5, the diverter opening or nozzle designated by the numeral 505 may be provided with inserts 507 received within the hole 509 and similarly an insert 510 may be provided in the corresponding jet orifice 512 in the annular outer member of the jet head. If desired, all of the nozzle and orifice passageways may be of a common size, be threaded, or otherwise suitably adapted to receive the inserts. Needless to say, these inserts may be of various size as to change the force of the output.

Figure 8:
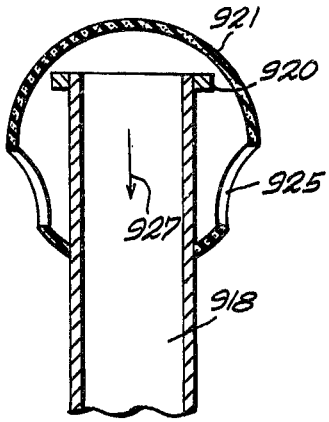
FIG. 8 is a partial view in cross section illustrating the upper portion of the air inlet tube of FIG. 2.

In use, with respect to the multi-jet head described above, it is seen that water will enter into the bottom of the diverter and, depending upon which row of the jet nozzles is open, at a given level, depending upon the adjustment of the annular rings 181, 183 and 185, the water will flow outwardly generally radially through the nozzles. This may occur in a wide variety of various patterns some of which are shown in the drawings, such as in FIGS. 4 and 6A through 6E. In operation, air will be pulled through inlet tube 18 when air control ball 921 in FIG. 8 is raised, then through openings 130 in the upper end of the diverter, longitudinal passageways in blocking rings 181, 183 and 185 (as shown at 309 and 311 in FIG. 4). In chamber 118 the air becomes entrained in the water jet streams to provide a constant supply of air and pressurized water passing through the jet orifices 120 at the level which is not blocked. Thus there is provided an outflowing stream of water or water and air. If desired, the user by manipulating the push-pull rods 201, 201′, 207 and 207′ may adjust the blocking rings 181, 183, and 185, so that the outflow will take place at any of the four nozzle levels seen in FIG. 2. The top level appears to be closed in FIG. 3 because it is a view wherein the nozzles are of the configuration shown, for example, in FIG. 6C or 6D.

Figure 7:
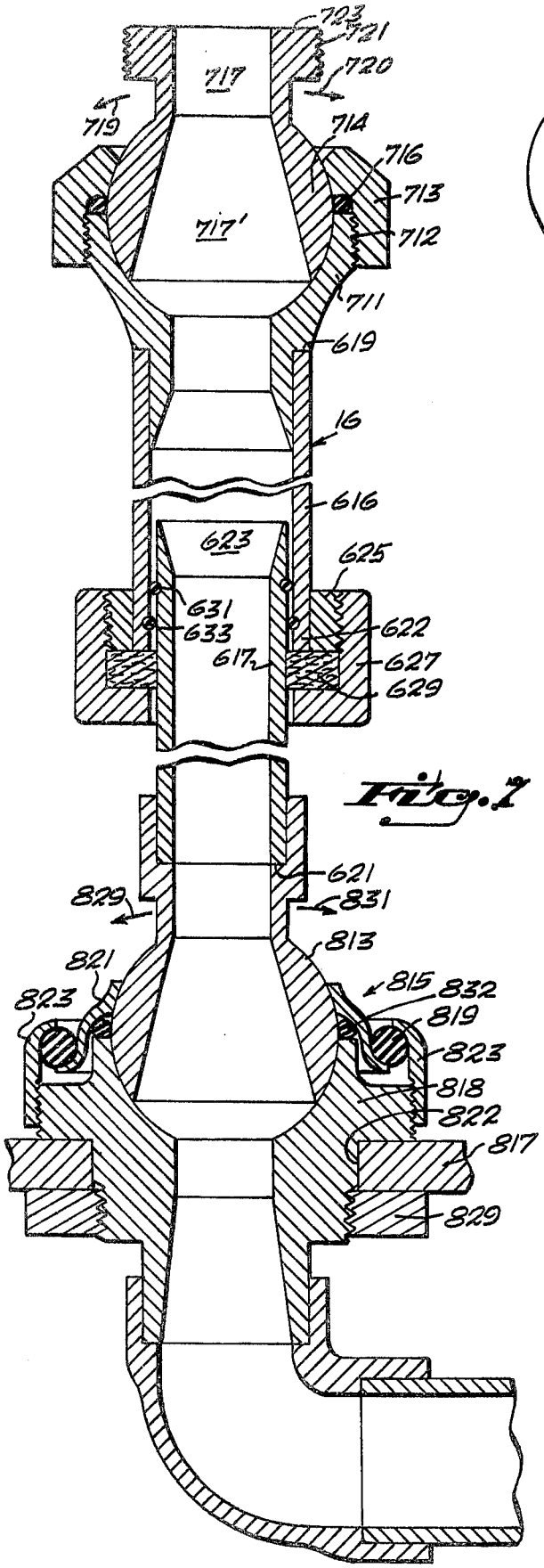
FIG. 7 is a view in cross section illustrating the water inlet tube at the lower portion of FIG. 2.

Referring now to FIG. 7, the water inlet tube 16 of the preferred embodiment is composed of an outer tubular member 616 and an inner tubular member 617 having respective outer ends 619 and 621 and inner ends 622 and 623. The latter ends are mated together in telescoping relation with one another. Also, to the inner end of the outer tube 616 a flange 625 is fixed which is exteriorly threaded to companionately and threadably engage the mating cap nut 627 to squeeze a washer 629 into frictional engagement with the wall of the inner tube 617 when the two are in tight threaded engagement. Preferably a keeper means in the form of a pair of wires 631 and 633 are provided, one being within an annular groove of the inner tube 617 and one being within the annular groove of the outer tube 616 so that the two tubes do not separate in response to water pressure in the event that washer 629 is not tightly engaged with the inner tube. It is thus seen that by reason of this structure the height or level location of the jet assembly head can be adjusted.

With respect to the water inlet tube it is preferably adjustable by ball and socket means now to be described on continuing reference to FIG. 7. In the preferred embodiment to the upper end a socket 711 is secured which is exteriorly theaded as at 712 for threaded engagement with a keeper ring 713 which maintains a ball 714 captivated thereto and with an O-ring 716 therebetween. The ball 714 is provided with a diametrical passageway 717 which has an opening which is enlarged as at 717′ and which accommodates tilting movement as indicated by the arrowed lines 719 and 720. The threaded outer end 721 of ball 714 is adapted for engagement in the threads 161 at the lower end of the outer bearing race member 141 in FIG. 3 as previously described. Surface 723 engages washer 163.

Similarly, at the lower end of the water inlet tube a ball 813 may be provided with a breakaway keeper means generally designated by the numeral 815 connecting it to the floor 817 of the spa or tub. In the preferred embodiment shown, this breakaway keeper means comprises a socket 818 which passes through a hole 822 in the tub floor 817 and below the floor is threaded externally for engagement with a keeper nut 829. The breakaway keeper means further includes an O-ring 819 captivated between and a pair of mating keeper rings 821 and 823 which in combination with the socket permit the ball 813 to tilt in the direction of the arrowed lines 829 and 831. In the preferred embodiment an O-ring 832 is provided which provides a seal at all times between the socket 818 and the ball 813. It is thus seen that the water inlet tube may be tilted into an inclined attitude through a 360 degree range so that the jet assembly means can be located within the spa at a relatively wide range of adjusted positions.

If inlet (water) tube 16 is deflected beyond approximately 30° from a normal vertical position by an occupant, keeper ring 821 will force O-ring 819 to compress, allowing ring 821 to release (climb upward) from engagement in socket 818, thus tube 16 will breakaway, preventing damage to the jet head.

With respect to the upper end of the air inlet, reference will now be made to FIG. 8 wherein the upper end zone 20 is shown. It is seen that the air inlet tube 918 is provided with an annular collar 920 and a ball preferably of rubbery material 921 is captivated thereon by this collar and the ball is provided with a plurality of openings such as 925. Thus, when the ball is moved axially so as not to be in engagement with the collar, air is adapted to be entrained through the openings, such as 925, and down through the center of the tube as indicated by the arrowed line 927 and into the jet head. Tube 918 may be connected to a source of pressurized air such as an air compressor to force additional air into the jet stream.

Preferably about the air inlet tube there is a float in the form of an annular member of buoyant material, such as that indicated by the numeral 24 in FIG. 2, so that the device is always clearly visible to a user entering the spa. It is adapted to float up and down always at the water level.

Figure 9:
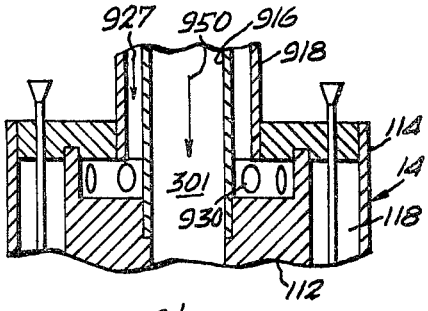
FIG. 9 is a section view of the jet head adapted to receive water and air from overhead connections.

Referring to FIG. 9, jet head 14 is shown in communication with the sources of air and water from above. Diverter 112 is modified to have the open end of the cup-shaped configuration at the top where water inlet tube 916 and air inlet tube 918 are coaxially arranged. Air flowing as indicated by line 927 enters annular chamber 118 through openings 930. Water flowing as indicated by line 950 enters water diverter chamber 301. Air control ball 921 would be modified to mount over water inlet tube 916 and the rotary bearing would be incorporated as part of water inlet tube 916 at a point above ball 921. The water inlet tube, incorporating the ball and socket connections and telescopic tubes would mount above the rotary bearing at one end and to a water inlet pipe from the pump, secured to an overhead supporting structure, at the other end. The breakaway keeper means could be deleted.

It is thus seen that there has been provided a system or assembly which is adapted to be utilized in connection with a spa, tub or swimming pool. It is adapted to direct hydrotherapeutic jet streams from a wide range of locations with respect to the central zone of the spa, in the embodiment shown, toward the occupants. It can be adjusted through a wide range as to location. The advantages are that less power is required as the jet stream travels a shorter distance from the center toward the occupants of the spa. Jet streams impinge on the front and sides of the occupants; and the jet streams may be rotating or fixed, repositioned to a wide range of adjustments by turning the jet head, and may be of an increased intensity or decreased intensity upon adjustment by an occupant. It provides a system which, on demand, can be changed by a user so that the jet stream flow pattern is varied to suit the taste of the user. For example, the jets may be fixed or rotating, or of high or low intensity. Spot or zone coverage may be selected as well as multiple to single jets, deep to shallow. Selectively the jets may be directed through 360° horizontal and 60° or more vertical coverage. The plane of the jet streams may be adjusted to a plane parallel or non-parallel to the water surface and in general provide coverage adaptable to non-circular spas as opposed to current practice of fixed in-the-wall jets which can usually only be individually directed through a 30° arc.

In summary, the jet assembly 14 as shown in FIG. 1 may be installed in a spa of any particular shape, such as that shown in FIG. 1, or that shown, for example, in FIG. 6E. It is a post mounted jet head 14 which will usually be centrally mounted to the base of the spa, or if more than one jet head is utilized, each would be mounted centrally to the area to be serviced. The assembly 14 is provided with an air inlet tube means and preferably a float means extending above the jet assembly 14 as shown in the preferred embodiment which in turn is mounted to the top of a water inlet tube means, which is preferably telescoping so as to be adjustable as to height and includes tilt means for tilting the same in an angular direction. Alternatively the device, instead of being supported on the floor, may be suspended from above the spa or indeed be connected to a water inlet tube connected to the side wall of the spa.

It will be seen that the multi-array jet may be controlled by using the control rods and that the size of the nozzles and their number may be varied within an array. Additional levels or arrays may be included by using additional push-pull rods. Also a spirally formed semi-flexible tube with an interior flexible hose could be used as the inlet tubes. The device shown here could also be used in conjunction with in-the-wall jets, if desired. Additionally, the device could be made as a single nozzle fixed, rotary or oscillating jet in its most rudimentary form.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatus and articles.

What is claimed is:

1. In combination with a spa, tub or swimming pool defining a receptacle for water, and a pump for recirculating water into and out of said receptacle, the improvement which comprises:

a jet head consisting of:

an inner member having a central inlet for receiving water from said pump and a plurality of outwardly facing discharge passageways to each discharge a jet of water into the receptacle;

an outer member extending around said inner member defining an annular chamber, said outer member having an orifice axially aligned with each discharge passageway;

an air inlet tube in fluid communication with said chamber at one end of said tube and a source of air at the other end of said tube;

and means for supporting and radially repositioning said jet head from a central position in the receptacle.

2. The combination of claim 1, wherein said supporting means comprises a post extending up in said receptacle and carrying said jet head on its upper end, said post defining a water passageway for conducting water from said pump to said jet head, said post being radially movable.

3. The combination of claim 2, wherein said post is adjustable for enabling the vertical adjustment of said jet head to various positions in said receptacle.

4. In a hydrotherapeutic system having a source of water under pressure and a water-filled receptacle, a water inlet tube having an entrance end connected to said source of water and an exit end;

a jet head having a water inlet connected to said exit end of the water inlet tube, said jet head being positioned substantially centrally of said receptacle and submerged under water in the receptacle, said jet head comprising:

a water diverter in fluid engagement with said water inlet and having at least one generally horizontal row of openings therein for passing water laterally outward;

at least one annular ring extending around said diverter for blocking said openings therein;

an annular member extending around the diverter and in spaced relation from said diverter defining an annular chamber about the diverter which receives said ring, said annular member having orifices axially aligned with said openings in the diverter;

said ring being contained in said annular chamber to selectively block both said openings in the diverter and said orifices in said annular member and having openings therein communicating with said chamber;

and an air inlet in fluid communication with said annular chamber through said openings in said ring;

an air inlet tube in fluid communication with said air inlet at one end and a source of air at the other end;

and adjustment means for adjusting the location axially of the annular ring.

5. In a jet assembly for use in a spa or the like, the combination of a water inlet tube for connection at one end to a source of water under pressure and a jet head on the opposite end of said water inlet tube, said head having:

an annular outer member formed with a plurality of rows of jet orifices, with the orifices in each row spaced apart circumferentially and the rows of orifices spaced apart lengthwise of the jet head;

a water diverter extending longitudinally inside said annular outer member and spaced radially inward from said outer member to provide an annular chamber between them, said diverter having an internal longitudinal chamber which at one end opens into said water inlet tube and at its opposite end is closed, said diverter having a plurality of rows of openings which are aligned individually with said jet orifices in said outer member for discharging water to said jet orifices;

a plurality of blocking rings in said annular chamber between the diverter and said outer member to block said openings in the diverter from the corresponding jet orifices in said outer member;

and means for selectively adjusting said rings lengthwise of said annular chamber to uncover a selected row of openings in the diverter and a corresponding row of jet orifices in said outer member and block the remaining rows of openings in the diverter and jet orifices in said outer member.

6. A jet assembly according to claim 5 and further comprising:

means for introducing ambient air into said outer member at one end of the jet head;

and wherein said blocking rings have longitudinal passageways for passing air from said one end of the jet head into said annular chamber at the location of the uncovered openings in the diverter to enable air to be entrained in the water issuing from the corresponding jet orifices in said outer member.

7. A spray assembly according to claim 6, wherein said means for introducing air is at the opposite end of the jet head from said water inlet tube.

8. A jet assembly according to claim 6, wherein said means for introducing air is a tube concentric with said water inlet tube at the same end of the jet head as said water inlet tube.

9. A jet assembly according to claim 5, wherein:

said rows of jet orifices in the outer member include a top row, upper and lower middle rows spaced in succession below said upper row, and a bottom row spaced below said middle rows;

said rows of openings in the diverter include a top row aligned with the top row of jet orifices, upper and lower middle rows aligned respectively with the upper and lower middle rows of jet orifices, and a bottom row aligned with the bottom row of jet orifices;

and said blocking rings include an upper ring slidable between a position blocking said top row of openings in the diverter and a position below said top row of openings in the diverter, a middle ring slidable between a position blocking said upper middle row of openings in the diverter and a position blocking said lower middle row of openings in the diverter, and a lower ring slidable between a position blocking said bottom row of openings in the diverter and a position above said lower row of openings in which it blocks said lower middle row of openings in the diverter;

upper push-pull rods connected to said upper ring and extending up from the jet head;

and lower push-pull rods connected to said lower ring and extending down from the jet head.

10. In a jet assembly for use in a spa or the like, the combination of a water inlet tube for connection at one end to a source of water under pressure, and a jet head on the opposite end of said water inlet tube, said jet head having:

an annular outer member formed with a plurality of rows of jet orifices, with the orifices in each row spaced apart circumferentially and the rows of orifices spaced apart lengthwise of the jet head;

a water diverter extending longitudinally inside said annular outer member and spaced radially inward from said outer member to provide an annular chamber between them, said diverter having an internal longitudinal chamber which at one end opens into said water inlet tube and at its opposite end is closed, said diverter having a plurality of rows of openings which are aligned individually with said jet orifices in said outer member for discharging water to said jet orifices;

means adjustably positioned in said annular chamber for selectively blocking certain rows of said openings in the diverter and jet orifices in said outer member;

and means mounting said jet head rotatably on said water inlet tube;

said openings in the diverter and said jet orifices in said outer member being operatively arranged to direct water laterally outward in a non-radial direction from the jet head to impart rotation to the jet head.

11. In a jet assembly for use in a spa or the like, the combination of a water inlet tube for connection at one end to a source of water under pressure, and a jet head on the opposite end of said water inlet tube, said jet head having:

an annular outer member formed with a plurality of rows of jet orifices, with the orifices in each row spaced apart circumferentially and the rows of orifices spaced apart lengthwise of the jet head;

a water diverter extending longitudinally inside said annular outer member and spaced radially inward from said outer member to provide an annular chamber between them, said diverter having an internal longitudinal chamber which at one end opens into said water inlet tube and at its opposite end is closed, said diverter having a plurality of rows of openings which are aligned individually with said jet orifices in said outer member for discharging water to said jet orifices;

means adjustably positioned in said annular chamber for selectively blocking certain rows of said openings in the diverter and jet orifices in said outer member;

an air inlet tube extending up from said jet head and having its lower end operatively arranged to pass air into said annular chamber;

and a float member on said air inlet tube below its upper end.

* * * * *